US005086978A

United States Patent [19]

Fertig

[11] Patent Number: 5,086,978

[45] Date of Patent: Feb. 11, 1992

[54] MULTIPLE JAR TURRET AIR BRUSH

[76] Inventor: Douglas B. Fertig, 54 Oak St., Deer Park, N.Y. 11729

[21] Appl. No.: 635,976

[22] Filed: Dec. 31, 1990

[51] Int. Cl.[5] ..... B05B 7/30

[52] U.S. Cl. ..... 239/305; 239/303; 239/340; 239/525; 222/144

[58] Field of Search ..... 239/303, 304, 305, 307, 239/302, 306, 308, 525, 526, 340, 418; 137/625.41; 222/144, 144.5

[56] References Cited

U.S. PATENT DOCUMENTS

| | | | |
|---|---|---|---|
| 912,106 | 2/1909 | Frazier | 239/305 |
| 1,090,863 | 3/1914 | Kelley | 239/305 |
| 1,270,553 | 6/1918 | Rouge | 239/305 |
| 1,652,422 | 12/1927 | Ascherl | 222/144 |
| 4,135,646 | 1/1979 | Shaw | 239/305 |
| 4,508,271 | 4/1985 | Gress | 239/307 |

FOREIGN PATENT DOCUMENTS

| | | | |
|---|---|---|---|
| 964242 | 3/1975 | Canada | 222/144.5 |
| 1070911 | 2/1954 | France | 239/305 |

*Primary Examiner*—Andres Kashnikow
*Assistant Examiner*—Christopher G. Trainor
*Attorney, Agent, or Firm*—Richard L. Miller

[57] ABSTRACT

A multiple jar turret airbrush is provided and consists of a turret having a top stationary member and a bottom rotating member coupled to the top stationary member, a plurality of paint jars, radially suspended downwardly from the bottom rotating member of the turret, an air brush assembly fluidly connected to the top stationary member of the turret and a mechanism for retaining the bottom rotating member in one of a plurality of positions with the top rotating member so that any one of the paint jars can be fluidly connected to the air brush assembly and the liquid in the respective paint jar can be utilized by the air brush assembly.

3 Claims, 2 Drawing Sheets

MULTIPLE JAR TURRET AIR BRUSH

BACKGROUND OF THE INVENTION

The instant invention relates generally to spraying apparatuses and more specifically it relates to a multiple jar turret air brush.

Numerous spraying apparatuses have been provided in the prior art that are adapted to include a plurality of fluid inlet ports communicating with a discharge nozzle. For example, U.S. Pat. No. 3,179,341 to Plos et al; U.S. Pat. No. 4,546,922 to Thometz and U.S. Pat. No. 4,667,880 to Paulsen et al all are illustrative of such prior art. While these units may be suitable for the particular purpose to which they address, they would not be as suitable for the purpose of the present invention as hereafter described.

SUMMARY OF THE INVENTION

A primary object of the present invention is to provide a multiple jar turret air brush that will overcome the shortcomings of the prior art devices.

Another object is to provide a multiple jar turret air brush in which one of a plurality of paint jars in the turret can be selectively positioned by rotating the turret so as to be fluidly connected to an air brush to be used.

An additional object is to provide a multiple jar turret air brush in which one of the paint jars may contain cleaning fluid so that time will be saved, since there will be no difficult encountered in changing from a paint jar to a cleaning fluid jar as is required with single paint jar air brush in order to effect the instrument's cleaning.

A further object is to provide a multiple jar turret air brush that is simple and easy to use.

A still further object is to provide a multiple jar turret air brush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 2:
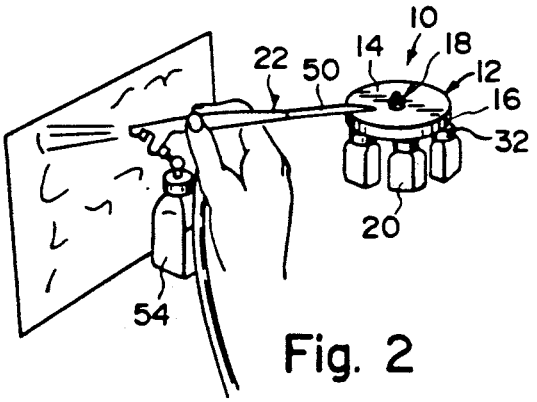
FIG. 2 is a diagrammatic perspective view similar to FIG. 1, but illustrating the invention utilizing a separate paint jar for dispensing the paint.

Turning now descriptively to the drawings, in which like reference characters denote like elements throughout the several views, the Figures illustrate a multiple jar turret air brush 10 consisting of a turret 12 having a top stationary member 14 and a bottom rotating member 16 coupled at 18 to the top stationary member 14. A plurality of paint jars 20 are radially suspended downwardly from the bottom rotating member 16, of the turret 12. An air brush assembly 22 is fluidly connected to the top stationary member 14 of the turret 12. A mechanism 24 is for retaining the bottom rotating member 16 in one of a plurality of positions with the top rotating member 14. Any one of the paint jars 20 can be fluidly connected to the air brush assembly 22 and the liquid 26 in the respective paint jar 20 can be utilized by the air brush assembly 22.

The air brush assembly 22 is fluidly connected to the top stationary member 14 of the turret 12 by an elongated siphon hose 28 extending between the air brush assembly 22 and a passageway 30 in said top stationary member 14. The bottom rotating member 16 of the turret 12 further includes a plurality of paint jar caps 32 secured in a radially distribution of the underside thereof so that the threaded necks 34 of the paint jars 20 can be threaded onto the caps 32. A siphon tube 36 extends through the bottom rotating member 16 and each of the paint jar caps 32. O-ring 38 is secured about the top of each of the siphon tubes 36 on the bottom rotating member 16 so that when the bottom rotating member 16 is turned, any one of the siphon tubes 36 can align with the passageway 30 in the top stationary member 14 with its respective O-ring 38 sealing the fluid connection therebetween.

The retaining mechanism 24 includes a spring 40 carried in the top surface 42 of the bottom rotating member 16 of the turret 12. A ball 44 is on the spring 40 to be biased upwardly towards the bottom surface 46 of the top stationary member 14 of the turret 12. The top stationary member 14 has a plurality of recesses 48 formed radially in the bottom surface 46 thereof so that each recess 48 can engage with the ball 44 when the bottom rotating member 16 of the turret 12 is turned.

Figure 1:
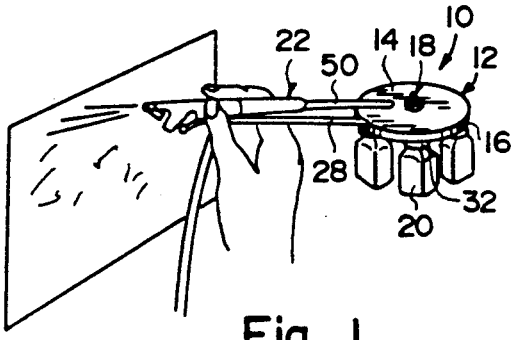
FIG. 1 is a diagrammatic perspective view of the instant invention illustrated with the hand held turret mechanism being used in a spray painting procedure.
Figure 3:
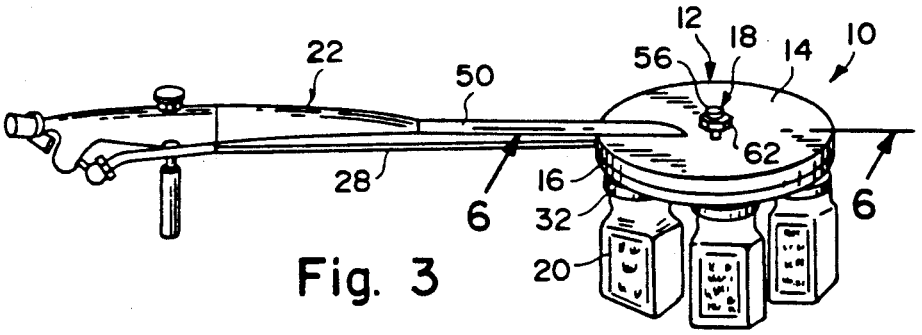
FIG. 3 is an enlarged perspective diagrammatic view of the invention shown in greater detail.
Figure 6:
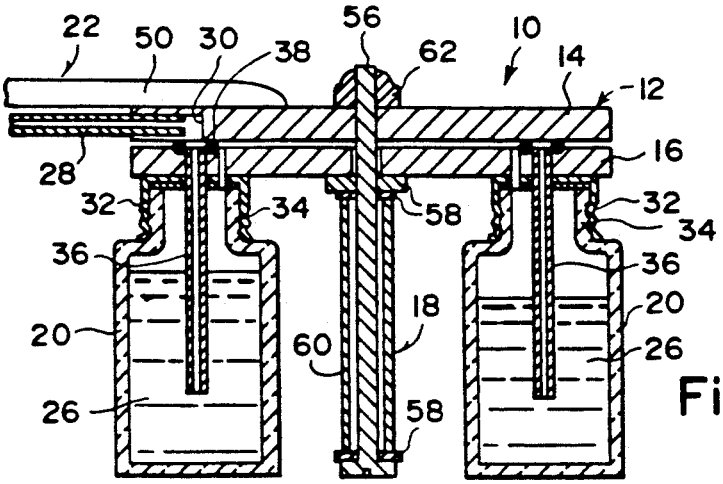
FIG. 6 is a cross sectional view taken on line 6—6 of FIG. 3 with parts broken away.
Figure 7:
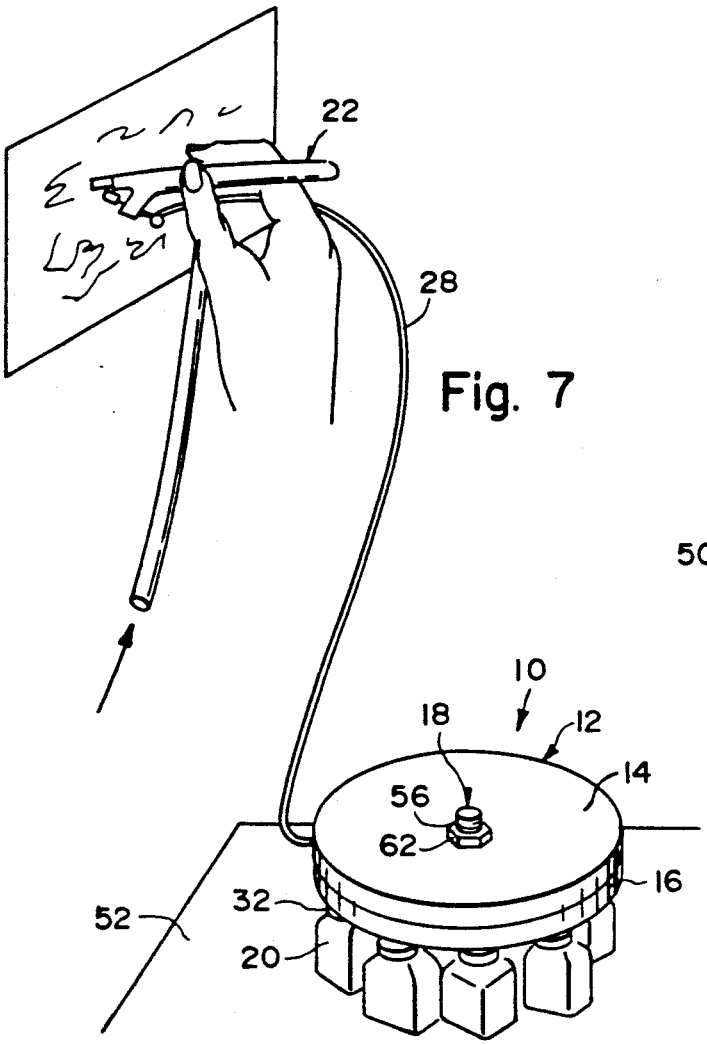
FIG. 7 is a perspective view of another embodiment shown typically with more containers and being used remotely from the air brush.
Figure 5:
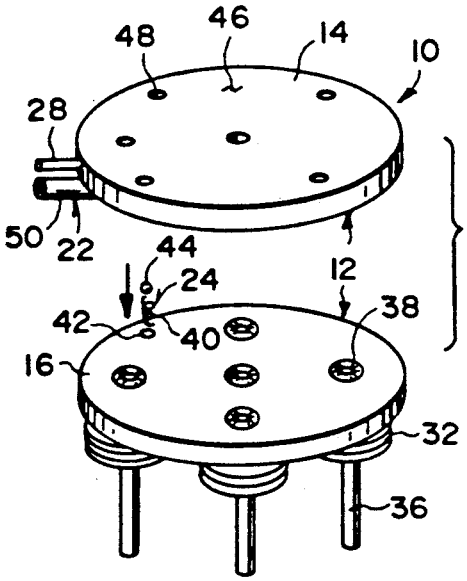
FIG. 5 is another perspective view of the turret mechanism with parts broken away.
Figure 4:
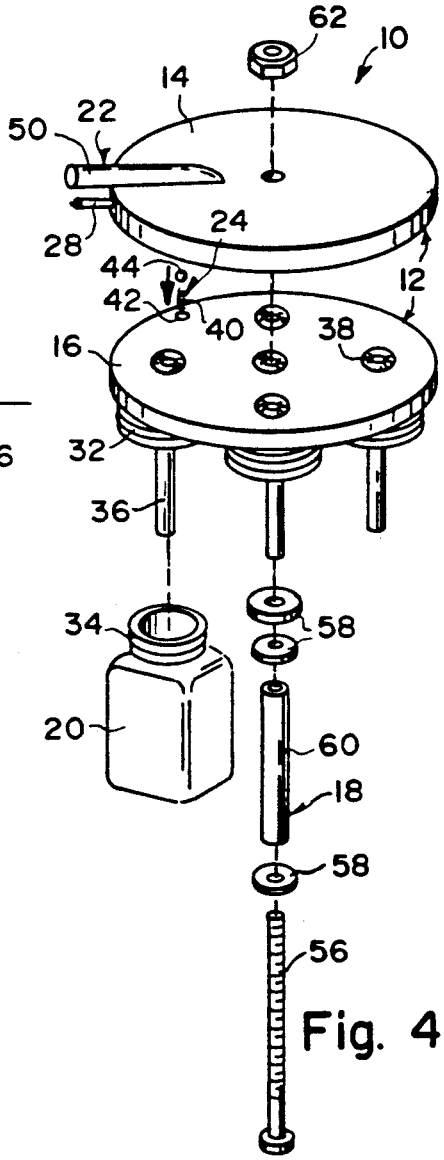
FIG. 4 is an exploded perspective view of the turret mechanism with parts broken away.

The turret 12 can be attached directly to an elongated handle 50 of the air brush assembly 22 as best seen in FIGS. 1 through 3 or separated and placed on a flat surface 52 as shown in FIG. 7. In some instances the turret 12 can be fluidly disengaged from the air brush assembly 22 and a regular single paint jar 54 can be fluidly connected to the airbrush assembly 22 as shown in FIG. 2. The coupling 18 can typically include an elongated bolt 56, three washers 58, a sleeve 60 and a nut 62 as best illustrated in FIGS. 4 and 6, but other types of couplings can also be used such as a rivet, a pivot pin, etc.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A multiple jar turret air brush comprising:

a) a turret having a top, stationary member and a bottom, rotating member rotatively coupled to said top stationary member;

b) a hand-held air brush assembly having flow control means thereon fluidly connected to said top stationary member of said turret by an elongated siphon hose extending between said air brush assembly and a passageway in said top stationary member providing remote control of the fluid flow; and c) a plurality of paint jar caps secured in a radial distribution onto the underside of the bottom member with threaded necks of paint jars threaded onto said caps to depend therefrom;

d) a plurality of siphon tubes, extending through said bottom rotating member and respective ones of said paint jar caps;

e) a plurality of O-rings, secured about the respective tops of said siphon tubes on said bottom rotating member so that said bottom rotating member can be turned to different rotary positions to bring any one of said siphon tubes into alignment with the passageway in said top stationary member with its respective O-ring sealing the fluid connection so that any one of said paint jars can be fluidly connected to said air brush assembly and the liquid in said respective paint jar be utilized by said air brush assembly; and f) means for retaining said bottom rotating member in any one of said rotary positions.

2. A multiple jar turret air brush as recited in claim 1, wherein said retaining means comprises:

a) a spring carried in the top surface of said bottom rotating member of said turret;

b) a ball on said spring to be biased upwardly towards the bottom surface of said stationary member of said turret; and c) said top stationary member having a plurality of recess formed radially in the bottom surface thereof so that each said recess can engage with said ball when said bottom rotating member of said turret is turned.

3. A multiple jar turret air brush as recited in claim 2 wherein the turrets are overlying, disc-like members and nut and bolt means extend through the centers thereof for clamping the members rotatively together.

* * * * *